US005127201A

United States Patent [19]

Skvaril

[11] Patent Number: 5,127,201

[45] Date of Patent: Jul. 7, 1992

[54] PREFABRICATED COMPACT SEVICE CORE

[76] Inventor: Joseph Skvaril, 4807 - 143 St., Edmonton, Alberta, Canada, T6H 4C9

[21] Appl. No.: 500,019

[22] Filed: Mar. 26, 1990

[51] Int. Cl.[5] ..... A47K 03/16

[52] U.S. Cl. ..... 52/34; 52/79.1; 52/236.6

[58] Field of Search ..... 52/79.1, 34, 234, 745, 52/236.3, 236.4, 236.6, 27, DIG. 12

[56] References Cited

U.S. PATENT DOCUMENTS

| | | | |
|---|---|---|---|
| 1,086,031 | 2/1914 | Davis | 52/236.6 |
| 2,419,319 | 4/1947 | Lankton | 52/27 |
| 3,162,277 | 12/1964 | Markle | 52/27 |
| 3,162,863 | 12/1964 | Wokas | 52/34 |
| 3,304,675 | 2/1967 | Graham-Wood et al. | 52/745 X |
| 3,593,469 | 7/1971 | Wall | 52/79.1 X |
| 3,601,937 | 8/1971 | Campbell | 52/27 |
| 4,078,343 | 3/1978 | Moore, Jr. | 52/79.1 |
| 4,574,533 | 3/1986 | Bigelow, Jr. et al. | 52/34 |
| 4,667,580 | 5/1987 | Wetzel | 52/282 X |
| 4,854,094 | 8/1989 | Clark | 52/79.1 |
| 5,012,621 | 5/1991 | Power et al. | 52/DIG. 12 |

FOREIGN PATENT DOCUMENTS

| | | | |
|---|---|---|---|
| 740594 | 8/1966 | Canada . | |
| 1105201 | 7/1981 | Canada . | |
| 1609200 | 2/1970 | Fed. Rep. of Germany | 52/27 |
| 6500325 | 7/1966 | Netherlands | 52/27 |

*Primary Examiner*—David A. Scherbel
*Assistant Examiner*—Lan Mai
*Attorney, Agent, or Firm*—Morrison & Foerster

[57] ABSTRACT

Walls of the prefabricated compact service core structure are higher than the total height of the floor, wall and ceiling structure of an ordinary one-storey residential building, but lower than the total height of a two-storey building of any kind. The height of the walls is large enough to e.g. accommodate the serviced fixtures of complete main floor bathroom, kitchen, and possibly laundry and utility rooms, as well as lower parts of the same rooms of the second storey of a two-storey structure. On the other hand, the height is small enough to make the prefabricated compact service core structure possible to ship on standard low trailers anywhere in the world. The prefabricated compact service core structure allows for factory completion of all major plumbing, heating, ventilation, and electrical work for a two-storey building, and easy on site hook-up to sewer, water, gas and electrical services from the bottom of the prefabricated compact service core structure ventilation and possibly electrical services may be extended above the top of the core through one or more extension service panels. As all portions of the floor of both storeys and high plumbing wall are suspended, premanufacturing of the service core in the plan can easily match all custom designed floor heights or deviations from them usually originating from the supply of building lumber of irregular dimensions.

15 Claims, 5 Drawing Sheets

PREFABRICATED COMPACT SEVICE CORE

FIELD OF THE INVENTION

The present invention relates to prefabricated buildings and more particularly to service cores for multi-storey prefabricated buildings.

BACKGROUND

One problem area in the prefabrication, shipment and assembly of two-storey prefabricated buildings is the installation and assembly of the building services, for example plumbing, heating, ventilation and electrical services. With a prefabricated building it is often desired to have the services concentrated in the service core of the building. To effect this, some manufacturers are prefabricating either plumbing walls or complete single storey service units. Multi-storey units are not manufactured because a two-storey structure providing plumbing, heating, ventilation and electrical services is not transportable either in a vertical or horizontal position.

While attempts have been made to stack two one-storey service units, this is not practicable for a number of reasons. The resultant assembly has a double structure including the ceiling of the lower unit and the floor structure from the upper unit. In addition, access to service connections between the stacked units must be maintained. Furthermore, this requires the performance of highly professional service connecting work on the building site. This makes the prefabrication of stacked units of this type ineffective.

The present invention addresses this problem and provides a service core for a multi-storey building that may conveniently be shipped and that maximizes the factory content of the plumbing, heating, ventilation and electrical work.

SUMMARY

According to the present invention there is provided a prefabricated service core for a building having first and second stories, the service core comprising:

a service wall extending the height of the first storey and a part of the height of the second storey;

upper and lower floor sections secured to the service wall to provide a first storey core section therebetween and a second storey core section above the upper floor section;

serviced fixtures mounted in the first and second storey core sections; and building services carried by the service wall and coupled to each of the serviced fixtures.

Because the service core of the invention is more than one storey high, it includes not only the entire serviced space of the first storey, but also the lower part of the serviced space of the second storey. The upper part of the second storey can easily be erected on site from factory premanufactured extension panels during the erection of the entire building structure. One or more of the extension panels may include a small proportion of the services, for example a single vent stack from the sewer lines, a ventilation duct from the upper part of the second storey of the service core, and some other components if needed. All of the extension wall panels can be shipped from the plant to the building site in a separate panel package.

The system may easily be applied to four-storey buildings and to each two additional floors. In apartment and hotel developments where the sources of heat and hot water are centrally located, the second floor plan may be exactly the same as the first floor plan. The service core may be arranged to accommodate any layout of the plumbing fixtures and serviced facilities. It may accommodate any shape of the structure, whatever is needed for the convenience of the service layout.

The service core is preferably a rectangularly shaped structure with three perimeter walls and an internal service wall that accommodates plumbing, heating, ventilation and electrical services for a back to back layout of the serviced fixtures. Four perimeter walls may be employed if desired.

Preferably, the two side walls perpendicular to the service wall are load-bearing walls that support the two floor sections.

The three side walls may be constructed with exterior wall sheathing on their inside faces. Similar sheathing may be used on the faces of the service wall. This in combination with the floor sections creates a rigid box structure to support such fragile wall finishes as ceramic tile applied over drywall. This protects the wall finish against cracking during loading, unloading and other rough handling of the service core structure.

The walls may be constructed with double plates at the top and bottom, with the plates of two joining walls overlapping at the corners. This provides a secure, rigid connection of the walls to one another. This rigidity may further be enhanced by screwed connections of the floor headers to the walls.

The top of the service core is protected against the weather by a sloped deck arrangement and a protective membrane. These are arranged so as not to prevent the erection of the extension wall panels and subsequent removal of the protective membrane and the decks after the entire building is erected.

Openings in the walls of the core are also preferably weather protected and arranged so as not to obstruct the erection of the building. They are arranged to allow for easy removal of those portions of the sheathing over intended wall openings whenever needed during the construction of the building.

The ends of the load-bearing side walls have double end studs that are provided with pick up holes so that the complete unit can be suspended from a cable assembly.

Those parts of the protective sheathing of the core which are to be removed during or after the building erection are factory pre-cut to minimize the creation of dust in the service core.

BRIEF DESCRIPTION OF THE DRAWINGS

In the accompanying drawings which illustrate an exemplary embodiment of the present invention.

DETAILED DESCRIPTION

Figure 3:
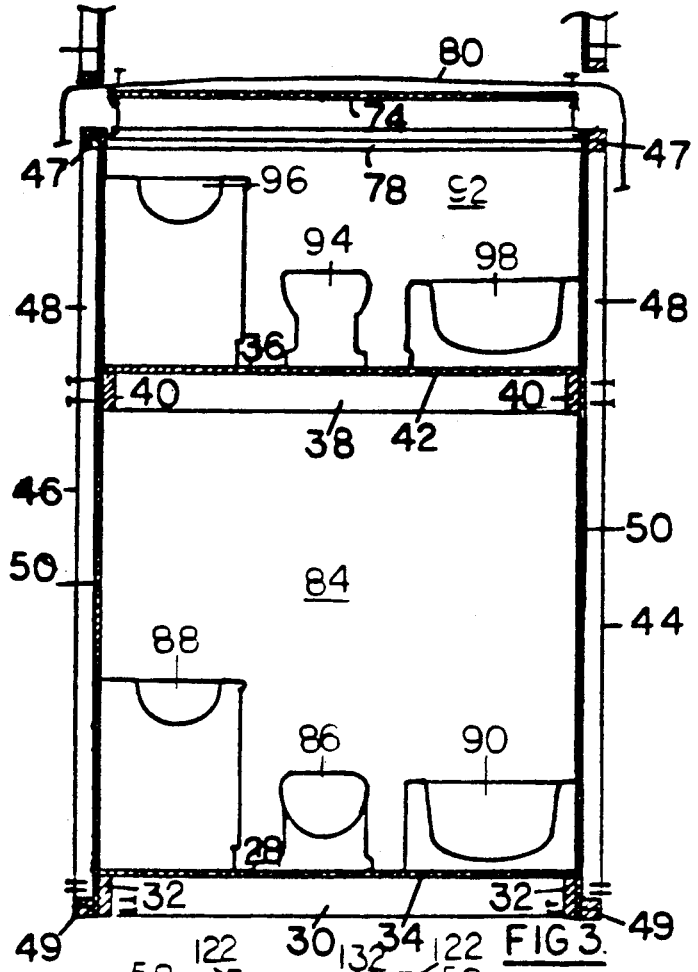
FIG. 3 is a view along line 3—3 of FIG. 1.

Referring to the accompanying drawings there is illustrated a service core 10 for a two-storey building. The service core includes a service wall 12 fabricated from a double top plate 13, vertical studs 14 and a double bottom plate 15. A sheath 16 of structural material, for example an appropriate grade of plywood, is secured to the studs and plates on one side of the wall. On the other side of the wall is a sheath 18 that is secured over the studs after services have been installed in the service wall. The service wall accommodates the various services required by the building including water pipes 20, drain pipes 22, electrical lines 24 and air ducts 26. Mounted on the service Wall 12 is a lower floor with a major section 28 on one side of the wall and a minor section 29 on the opposite side. The floor includes joints 30 that run parallel to the service wall and are secured at opposite ends to headers 32 as illustrated most particularly in FIG. 3. The joists and headers support floor panels 34 and 35. An upper floor with major and minor sections 36 and 38 is likewise composed of joints 37 respectively parallel to the service wall 12 and headers 40 supporting floor panels 42 and 43.

The floor headers are fastened to two side walls 44 and 46 extended across the opposite ends of the service wall 12 and normal thereto. These are load-bearing walls, each with a double top plate 47, a series of vertical studs 48 and a double bottom plate 49. A structural load-bearing sheath 50 is secured to the studs and the plates of each wall, on the inside. At each end of the wall are double studs 52.

An additional perimeter wall 54 extends upwardly from the major floor section 36; between the side walls 44 and 46, parallel to and spaced from the service wall 12. Wall 54 has a double top plate 55, vertical studs 56 and a double bottom plate 57. Sheathing 58 covers the inside face of the wall except for two openings 60, one between the upper and lower floors and one above the upper floor. Double studs 62 are located on opposite sides of the opening 60A. A similar opening 68 is provided in the wall 46 one below floor panel 42 and one above floor panel 42 again with double studs 64 on its opposite sides.

The top plates 47 and 55 of the walls overlap at the corners and are fastened together and to the double studs at the corners to provide a rigid box structure that resists deformation. The major section 36 of the upper floor extends between the walls 44, 46 and 54 and the service wall 11 on one side of the service wall and the minor section 37 of the upper floor extends between the walls 44 and 46 and the service wall, on the other side of said service wall. This upper floor is spaced above the lower floor and defines, with the walls and service wall, a lower one storey high section, with the upper floor sections 36 and 37 also acting as the ceiling for this lower one storey high section.

Fastened to the upper ends of studs 64 on each side of each opening 60 60A above floor are blocks 64A that support removable decks 66 which close the openings for transportation purposes.

A transverse brace 68 extends between the side walls 44 and 46, near the top on that side of service wall 12 opposite the wall 54. This brace 68 supports a vertical closure panel 70 that encloses the open side of the service core opposite the wall 54. As illustrated most particularly in FIG. 6, certain areas of the closure panel 70 are outlined by long slots 72 through the panel so that those areas can be opened readily during or after installation as shown in FIG. 7, with a minimal amount of dust generation.

The top of the service core is closed temporarily with two decks 74. These are supported On blocks 76 extending along the top of the service wall 12, so that the edges of the decks are supported above the top of the wall. At the plate 55 of wall 54, blocks 78 are lower and are positioned so that the top surface of the deck 74 is flush with the top of the double plate 55. Along the opposite side of the service core, the deck is supported on the top of the brace 68 at the same level as on the blocks 78. The decks 74 thus slope downwardly away from the service wall.

A waterproof membrane 80 is placed over the top of the entire core and fastened in place.

Figure 1:
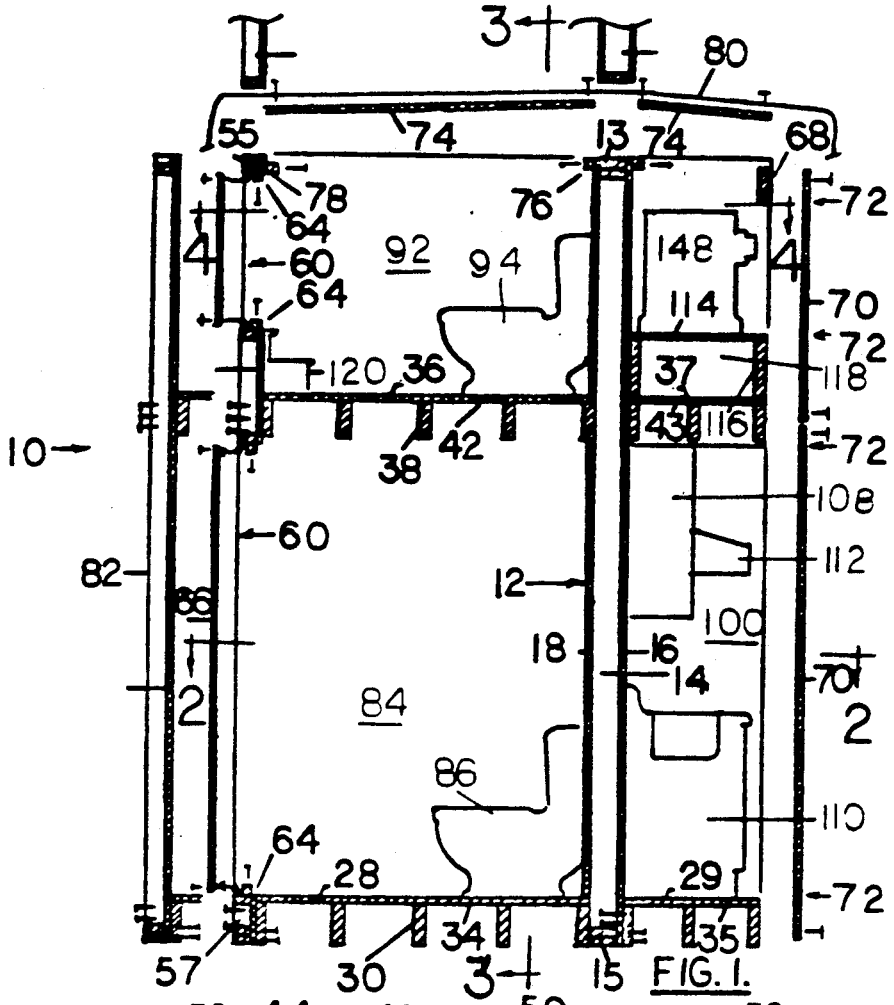
FIG. 1 is a vertical cross-section through a service core, perpendicular to the service wall.
Figure 2:
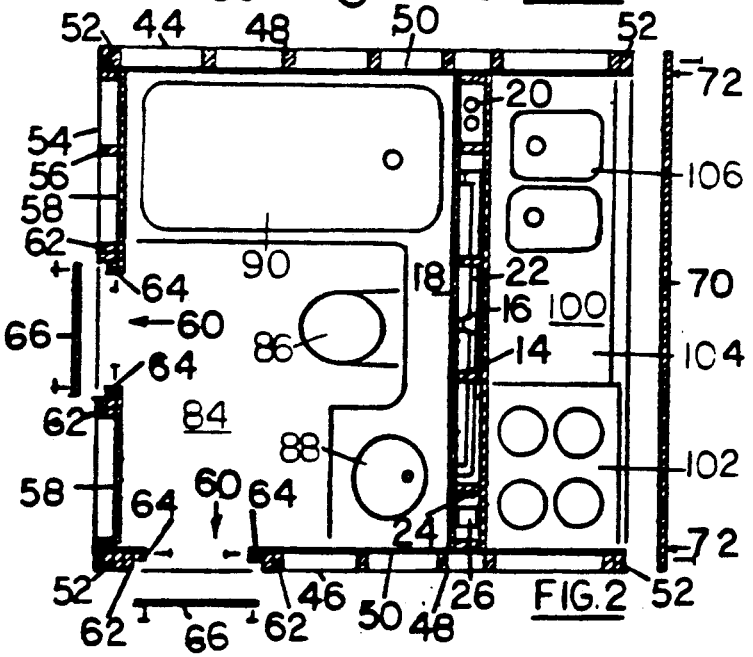
FIG. 2 is a section along line 2—2 of FIG. 1.

FIG. 1 illustrates an alternative to the wall 54 with its opening 60. In this case, the wall is a solid wall 82 with no openings, access to the service core being through openings in wall 46.

The service core as illustrated includes a lower floor bathroom 84 between the lower and upper floors. This includes a toilet 86, a sink 88 and a bath tub 90 all mounted in the unit and coupled to the appropriate plumbing lines in the service wall. Immediately above the bathroom 84 is a second bathroom 92 equipped with a toilet 94, a sink 96 and a bath tub 98, again coupled to the Water and drain lines in the service wall.

On the opposite side of the service wall from bathroom 84 is a kitchen service area 100. This accommodates a range 102, a counter 104 with a sink 106, cupboards 108 and 110 and a range hood 112. Electrical and plumbing connections are made to the appropriate supplies within the service wall.

Above the kitchen area 100 is a furnace room with a floor 114 raised on joists 116 above the floor 37. This leaves a chamber 118 for air return ducting and the like. The furnace room accommodates a furnace 148 and a water heater 150.

It will be noted that the partial portions of the walls, namely 44A, 46A, 54A and 11A, terminate at less than half the height of the lower one storey high section or just above the appliances contained therein.

Figure 5:
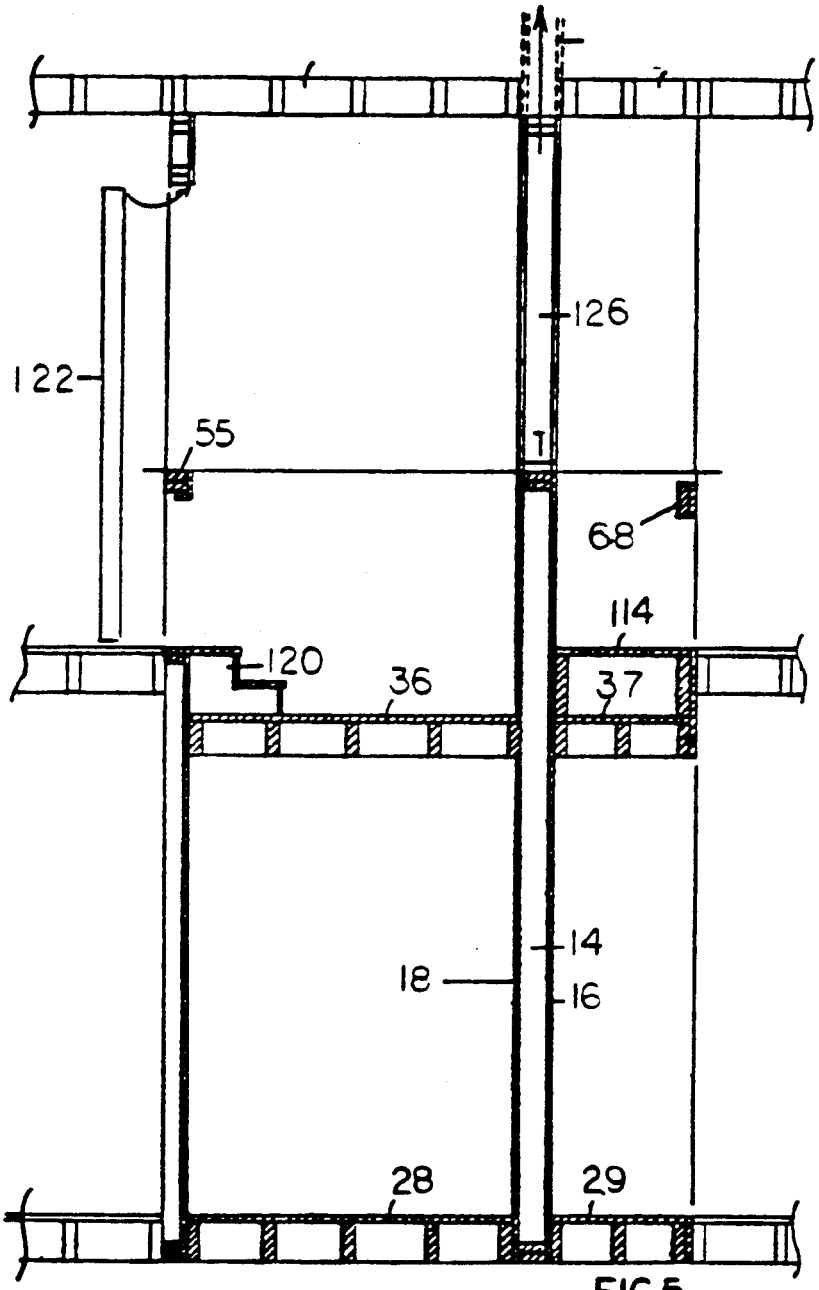
FIG. 5 is a vertical cross section showing the assembly of the service core in a building.

The upper bathroom 92 is illustrated as including stairs 120 leading up to the upper access opening 60 which is at the same level as the raised floor 114 in the furnace room. As illustrated in FIG. 5, this level is coincident with the floor level of the upper storey of the building. This arrangement can be used to shorten the service core somewhat where this is desired. In alternative embodiments, the stairs may be eliminated or indeed may lead to a raised floor in the service core.

The service core is completed during erection of the building by installing wall extensions above the partial walls 44A, 46A, and 54A and the transverse brace 60A. of the partial upper storey of the service core. Where openings are provided in the walls of the upper storey, the blocks 64 are removed, the double plate is cut at the top of the opening and frame ties 122, which are additional studs, are installed on either side of the opening. These are secured to studs 62 and studs extending along the sides of matching openings in the wall extensions.

As illustrated most particularly in FIG. 7, the extension walls may include extension walls 123 and 124 that are secured to the tops of the load-bearing walls 44 and 46 respectively of the service core. A further extension wall 125 mounts on the top of the additional wall 54. The service wall may be extended with an extension wall 126 that includes a vent pipe 128 exposed at the bottom of the extension wall through a notch 130 so that it is accessible for connection to the matching vent pipe in the service wall. The extension of the service wall may have an upwardly extended section that projects beyond the ceiling of the second storey where this is desired.

Figure 6:
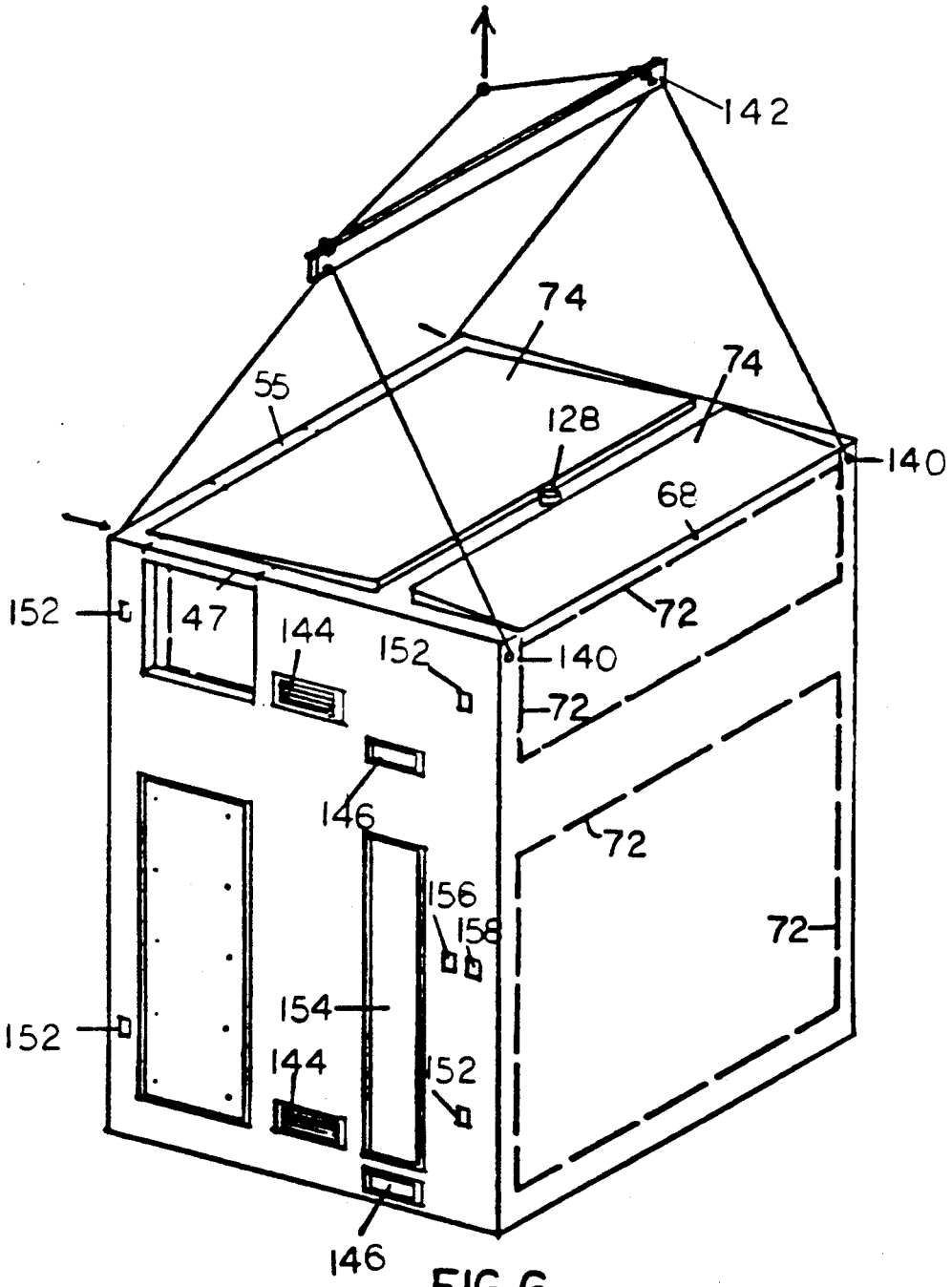
FIG. 6 is an isometric view of the service core ready for shipment.
Figure 7:
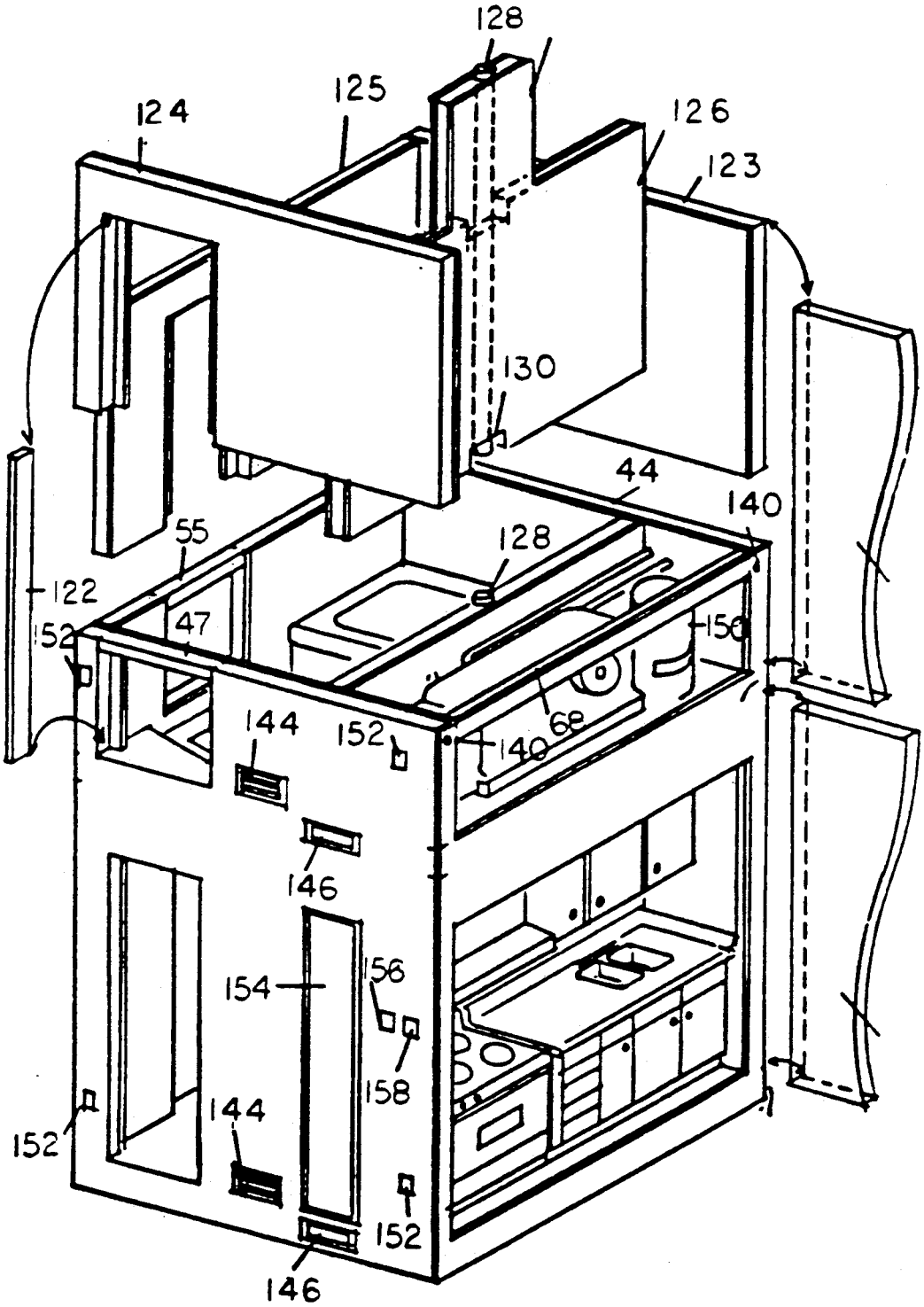
FIG. 7 is an isometric view of the unloaded service core showing the extension walls over the second floor.

As shown most particularly in FIGS. 1 and 6, the installation of the extension walls on the service core can be done without removing the top decks 74 until after final installation as in FIG. 5. The extension of the decks above the adjacent top plates provides for appropriate alignment of the extension walls. In the case of the extension of the service wall, it is simply necessary to remove a thin strip of the membrane between the raised edges of the top decks and to insert the bottom edge of the extension into the slot between the decks. The raised edges of the decks also protect the upper end of the vent pipe where it emerges from the top of the service wall during transportation and storage. Once the extension walls are installed, the upper ceiling 159, shown in FIG. 5, may be installed and the roof (not illustrated) erected in a conventional manner. Alternatively one or more additional storeys may be added. The supporting structure is shown partially in FIGS. 1 and 3 and identified by reference character 160. At his point, the decks 74 may be removed together with the waterproof membrane 80.

Figure 4:
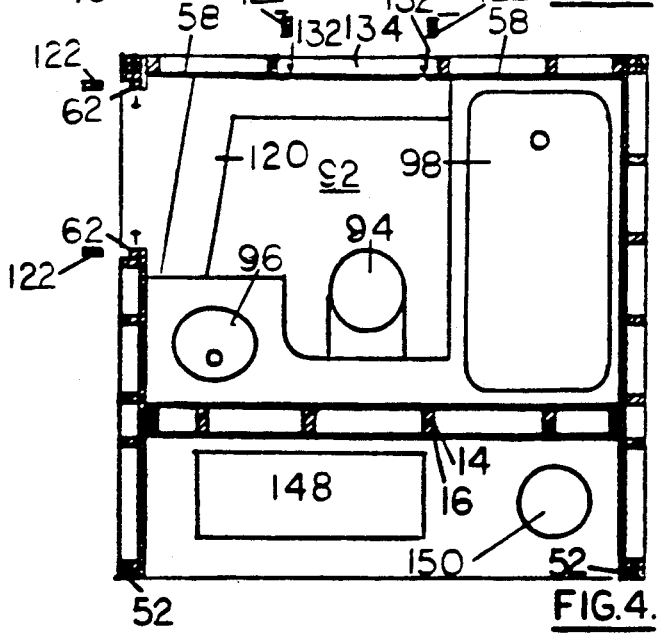
FIG. 4 is a view along line 4—4 of FIG. 1.

The openings in the wall sheathing may be closed by integral parts of the sheathing outlined with slots 132 so that the openings can be formed with a minimal amount of sawing, leaving a minimum amount of sawdust in the service core in the completed building. An arrangement of this sort is shown in FIG. 4, where the removable panel 134 is separated from the remainder of the sheath 58 by slots 132.

As illustrated in FIG. 6, openings 140 are formed in the corners of the service core, through the double studs at the corners. These serve for the connection of a sling 142 to the unit. The sling is used for loading and unloading the service core for shipping. The wall 46 is shown in FIG. 6 as having two air return ducts 144 and two air supply ducts 146 for connection to the heating system of the remainder of the building. These are connected through the service wall to the furnace 148. A series of electrical outlets 152 are carried on the wall 46 as well. Where desired a service cabinet 154 may be built in to house a breaker panel, a water meter and the like. This interior wall of the service core may also accommodate a thermostat 156 and a humidistat 158.

While one particular embodiment of the invention has been described in the foregoing, it is to be understood that other embodiments are possible within the scope of the invention. In particular, the layout of the service core equipment and the arrangement of the pipes and ducts may be arranged in a variety of different ways. The fixtures illustrated in the accompanying drawings may be replaced with alternative forms of fixture. The invention is therefore to be considered limited solely by the scope of the appended Claims.

I claim:

1. A prefabricated transportatable service core for a building comprising in combination:

(a) a one storey high lower section having a lower end and an upper end and a partial one storey high upper section having a lower end and an upper end above said lower section;

(b) said service core including a service wall extending vertically through said lower section from the lower end thereof and terminating at the upper end of said partial one storey high upper section, the height of said partial one storey high upper section being substantially less than the full height of said lower section;

(c) a lower floor spanning the lower end of said one storey high lower section and including a major section on one side of said service wall and a minor section on the other side of said service wall;

(d) a pair of spaced and parallel side walls extending upwardly from opposite sides of said lower floor in spaced and parallel relationship with one another and normal to said service walls and a perimetrical wall also extending upwardly, from between the ends of said side walls which are on the major section of said lower floor;

(e) an upper floor spanning the upper end of said lower section and including a major section on one side of said service wall and a minor section on the other side of said service wall, said upper floor also acting as a ceiling for said one storey high lower section and also constituting the upper end of said one storey high lower section and the lower end of said one storey high upper section, said side walls, said perimetrical wall and said service wall extending above said upper floor and terminating at said upper end of said partial one storey high upper section;

(f) a transverse brace extending between the upper ends of said side walls which are on the minor section of said upper floor;

(g) a pair of temporary decks spanning the upper end of said partial one storey high upper section just inboard of the upper ends of said end walls and said perimetrical wall, and engaging one upon each side of said service wall thereby enclosing said upper end of said partial one storey high upper section said temporary protected decks slope downwardly and away from said service wall towards said perimetrical walls;

(h) means on said upper ends of said end walls, and said perimetrical wall to support said temporary decks just inboard of said end walls and said perimetrical wall.

2. The prefabricated service core according to claim 1 in which a water resistant membrane covering said decks thereby allowing for the discharge of rain and the like to the outer perimeter of the upper end of said service core.

3. The prefabricated service core according to claim 1 which includes service fixtures mounted in said one storey lower section and in said partial one storey high upper section.

4. The service core according to claim 1 including a panel secured to and spanning the edges of said floor sections, each one of said end walls and said transverse brace, substantially parallel to the said service wall and on the side thereof remote from said perimetrical wall.

5. The service core according to claim 4 wherein said panel includes a plurality of slots therethrough, the slots being arranged in an array defining a removable part of the sheath.

6. The prefabricated service core according to claim 1 which includes service fixtures mounted in said one storey high section and in said portion of said another storey high section.

7. The service core according to claim 1 which includes wall extensions for said partial one storey high upper section and means to install same along the upper sides of said end walls, and said perimetrical wall and upon said transverse brace to complete said partial one storey high upper section.

8. The service core according to claim 1 including a waterproof membrane extending over the upper side of said service core and said decks and being secured thereto.

9. The service core according to claim 1 including a panel secured to and spanning the edges of said floor sections, each one of said end walls and said transverse brace, substantially parallel to the said service wall and on the side thereof remote from said perimetrical wall.

10. The service core according to claim 9 wherein said panel includes a plurality of slots therethrough, the slots being arranged in an array defining a removable part of the sheath.

11. A prefabricated transportatable service core for a building comprising in combination:

(a) a one storey high lower section having a lower end and an upper end and a partial one storey high upper section having a lower end and an upper end above said lower section;

(b) said service core including a service wall extending vertically through said lower section from the lower end thereof and terminating at the upper end of said partial one storey high upper section, the height of said partial one storey high upper section being substantially less than the full height of said lower section;

(c) a lower floor spanning the lower end of said lower section.

(d) a pair of spaced and parallel side walls extending upwardly from opposite sides of said lower floor and in spaced and parallel relationship with one another and normal to said service wall and a perimetrical wall also extending upwardly, from between the ends of said side wall on one side of said service wall;

(e) an upper floor spanning the upper end of said lower section, said upper floor also acting as a ceiling for said one storey high lower section and also acting as the upper end of said one storey high lower section and the lower end of said partial one storey high upper section, said side walls, said perimetrical wall and said service wall extending above said upper floor and terminating at said upper end of said partial one storey high upper section;

(f) service fixtures mounted in said one storey high lower section and in said partial one storey high upper section on each side of said service wall;

(g) building services carried by the service wall and coupled to each of the service fixtures;

(h) a transverse brace extending between the upper ends of said side walls on the other side of said service wall;

(i) wall extensions detachably securable around the upper sides of said side walls, said perimetrical wall and said brace to complete said portion of another storey high upper section on site; and (j) a temporary deck means extending over and secured to the upper end of said partial one storey high upper section, said deck means comprises two decks, located one on each side of said service wall, said decks slope downwardly away from said service wall.

12. The service core according to claim 11 wherein each perimetrical wall comprises a plurality of vertical studs and a load-bearing sheath secured thereto on an inner side of the studs.

13. The service core according to claim 11 wherein said decks span between said end walls and one extending between said service wall and said transverse brace, the other extending between said service wall and said perimetrical wall.

14. The service core according to claim 13 including a waterproof membrane extending over the upper side of said service core and said decks and being secured thereto.

15. The service core according to claim 11 in which said lower floor includes a major section on one side of said service wall and a minor section on the other side of said service wall, said upper floor includes a major section on one side of said service wall and a minor section on the other side of said service wall.

* * * * *